US005370962A

United States Patent [19]

Anderson et al.

[11] Patent Number: 5,370,962

[45] Date of Patent: Dec. 6, 1994

[54] TONER COMPOSITIONS WITH BLEND COMPATIBILITY ADDITIVES

[75] Inventors: Robert W. Anderson, Fairport; Susan J. Kremer, Webster; Michael L. Grande, Palmyra, all of N.Y.

[73] Assignee: Xerox Corporation, Stamford, Conn.

[21] Appl. No.: 24,134

[22] Filed: Mar. 1, 1993

[51] Int. Cl.[5] ..... G03G 5/00

[52] U.S. Cl. ..... 430/137; 430/106; 430/110

[58] Field of Search ..... 430/137, 106, 110

[56] References Cited

U.S. PATENT DOCUMENTS

| | | | |
|---|---|---|---|
| Re. 32,883 | 3/1989 | Lu | 430/110 |
| 4,221,856 | 9/1980 | Lu | 430/110 |
| 4,291,111 | 9/1981 | Lu | 430/107 |
| 4,298,672 | 11/1981 | Lu | 430/108 |
| 4,312,933 | 1/1982 | Lu | 430/122 |
| 4,338,390 | 7/1982 | Lu | 430/106 |
| 4,404,271 | 9/1983 | Kawagishi et al. | 430/110 |
| 4,411,974 | 10/1983 | Lu et al. | 430/106 |
| 4,433,040 | 2/1984 | Niimura et al. | 430/109 |
| 4,752,550 | 6/1988 | Barbetta et al. | 430/106.6 |
| 4,812,381 | 3/1989 | Bugner et al. | 430/110 |
| 4,845,003 | 7/1989 | Kiriu et al. | 430/110 |
| 5,204,208 | 4/1993 | Paine et al. | 430/137 |

*Primary Examiner*—Marion E. McCamish
*Assistant Examiner*—Mark A. Chapman
*Attorney, Agent, or Firm*—E. O. Palazzo

[57] ABSTRACT

A process for the preparation of colored toners which comprises providing a first toner comprised of resin, pigment particles, internal charge additive, and optional surface additives; adding thereto a second toner comprised of resin, pigment particles, internal charge additive, and optional surface additives; and wherein said toners contain blend compatibility components.

30 Claims, No Drawings

TONER COMPOSITIONS WITH BLEND COMPATIBILITY ADDITIVES

BACKGROUND OF THE INVENTION

The present invention is generally directed to toner and developer compositions, and more specifically, the present invention is directed to toner compositions containing on the surface thereof blend compatibility components, such as charge enhancing additives, to provide colored toners with improved blending or comixing characteristics. In embodiments, there are provided in accordance with the present invention processes to achieve effective toner blending or comixing compatibility, that is for example the overlapping of charge spectra and rapid blend admixing of the constituents in a blend of dry toner compositions comprised of resin particles, pigment particles, and optional charge additives dispersed therein, such as quaternary ammonium hydrogen bisulfates, including distearyl methyl hydrogen ammonium bisulfate, and the like by adding to the toner surfaces blend compatibility components. Thus, in embodiments with the present invention there can be obtained a palette, that is for example 10 reselected colored toners, or an extended set of colors by admixing certain toner compositions. One object of mixing or blending is to enable a minimum starting set of toners such as red, green, blue, cyan, magenta and yellow to generate many other colors by the method of comixing these toners, pairwise in embodiments, to provide toners with preselected colors, thus each new comixture, with a relative ratio of the constituent pair, can become a new toner to be added to a carrier to form a developer particularly useful in trilevel or color xerography. The aforementioned toner compositions usually contain pigment particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles, exceeding for example 500,000 in a number of embodiments. The toner and developer compositions of the present invention can be selected for electrophotographic, especially xerographic, imaging and printing processes, including full color processes.

Developer compositions with charge enhancing additives, which impart a positive charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like. Also of interest are U.S. Pat. Nos. 4,221,856, which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are illustrated in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430, and 4,560,635, which illustrates a toner with a distearyl dimethyl ammonium methyl sulfate charge additive.

The following United States patents are also mentioned: U.S. Pat. No. 4,812,381 which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethylsulfonate; U.S. Pat. Nos. 4,834,921 and 4,490,455, which discloses toners with, for example, amine salt charge enhancing additives, reference the Abstract of the Disclosure for example, and wherein A is an anion including those derived from aromatic substituted sulfonic acids, such as benzene sulfonic acid, and the like, see column 3, beginning at line 33; Reissue 32,883 (a reissue of U.S. Pat. No. 4,338,390) illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3 or 4; U.S. Pat. No. 4,323,634 which discloses toners with charge additives of the formulas presented in column 3, providing that at least one of the R's is a long chain amido group, and X is a halide ion or an organosulfur containing group; U.S. Pat. No. 4,326,019 relating to toners with long chain hydrazinium compounds, wherein the anion A can be a sulfate, sulfonate, phosphate, halides, or nitrate, see the Abstract of the Disclosure for example; U.S. Pat. No. 4,752,550 which illustrates toners with inner salt charge additives, or mixtures of charge additives, see for example column 8; U.S. Pat. No. 4,684,596 which discloses toners with charge additives of the formula provided in column 3 wherein X can be a variety of anions such as trifluoromethane sulfonate, and U.S. Pat. Nos. 4,604,338; 4,792,513; 3,893,935; 4,826,749 and 4,604,338.

Moreover, toner compositions with negative charge enhancing additives are known, reference for example U.S. Pat. Nos. 4,845,003; 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a process for developing electrostatic images with a toner which contains a metal complex represented by the formula in column 2, for example, and wherein ME can be chromium, cobalt or iron. Additionally, other patents disclosing various metal containing azo components wherein the metal can be chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Illustrated in U.S. Pat. No. 4,937,157 (D/89260), the disclosure of which is totally incorporated herein by reference, are toner compositions comprised of resin, pigment, or dye, and tetraalkyl, wherein alkyl, for example, contains from 1 to about 30 carbon atoms, ammonium bisulfate charge enhancing additives, such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14 to about 22 carbon atoms, and the like.

The disclosures of each of the U.S. patents mentioned herein, especially as they relate to toners with charge additives, are totally incorporated herein by reference.

A number of copending applications illustrate toners with negative charge additives such as U.S. Ser. No. 755,919 (D/90404) and U.S. Ser. No. 894,688 (D/92080), the disclosures of which are totally incorporated herein by reference.

SUMMARY OF THE INVENTION

It is an object of the present invention to provide toner and developer compositions with blending additives on the surface thereof.

In another object of the present invention there are provided processes for the preparation of blended or comixed toners with excellent color resolution, and where the toner contains blending components and dispersed therein charge additives.

In yet another object of the present invention there are provided processes for improving the blend or mix compatibility of colored toners by adding to the surface thereof blend compatibility components, such as charge additives, and which toners possess a number of excellent characteristics such as a combination of improved flow, conductivity, admix and blend compatibility.

There also is a need for positively or negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference.

Also, there is a need for toner compositions which have the desired triboelectric charge level, for example, from about 10 to about 40 microcoulombs per gram, and preferably from about 10 to about 25 microcoulombs per gram, and admix charging rates of from about 5 to about 60 seconds, and preferably from about 15 to about 30 seconds, as determined by the charge spectrograph, preferably, for example, at low concentrations, that is for example less than or equal to about 5 percent, and preferably from about 0.1 to about 2 percent of the charge enhancing additive component.

Also, in another object of the present invention there are provided developer compositions with positively or negatively charged toner particles, carrier particles, and the enhancing additives illustrated herein, or mixtures of these additives with other known charge enhancing additives.

Additionally, in a further object of the present invention there are provided negatively charged colored toner compositions containing therein charge enhancing additives, such as distearyl dimethyl ammonium methyl sulfate (DDAMS), quaternary ammonium hydrogen bisulfate, especially trialkyl ammonium hydrogen bisulfate, or tetraalkylammonium sulfonates, such as dimethyl distearyl ammonium sulfonates, and the like, and on the surface thereof blend compatibility components.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

Further, in another object of the present invention there are provided processes for toner blend compatibility or overlapping in the blend charge spectra, that is for example toners with similar or the same Q/O and wherein the charge distribution and blend have excellent admix.

Moreover, in another object of the present invention there are provided processes for obtaining preselected colored toners with rapid blend admixing characteristics by the blending of a number of toners, especially the blending of two toners, and thereafter formulating developer compositions by the addition of carrier particles thereto.

Another object of the present invention resides in the provision of surface treated toners enabling substantially similar or identical charging characteristics thereof, especially of individual toners, and excellent blend compatibility.

These and other objects of the present invention can be accomplished in embodiments thereof by providing toner compositions comprised of resin particles, pigment particles, optional internal charge enhancing additives dispersed therein and blend compatibility components on the surface thereof. In embodiments, the present invention is directed to a process for the compatible blending or comixing of toners, especially two toners, by adding to the surfaces thereof blend compatibility components. More specifically, the process comprises adding to a first toner, a second toner, a third toner, and a fourth toner a blend compatibility or blending additive to the surface of the toners, and which toners can then be effectively blended thereby enabling toners with excellent resolution and superior color intensity of preselected choices.

In embodiments, the present invention is directed to a process for the preparation of colored toners, which comprises providing a first toner comprised of resin particles, pigment particles and internal charge additive and optional surface additives, and adding thereto a second toner comprised of resin particles, pigment particles, internal charge additive and optional surface additives, and wherein said toners contain blend compatibility components, especially on the surface; a process for the preparation of blended toners, which comprises the preparation of a first toner, the preparation of a second toner, the preparation of a third toner, and the preparation of a fourth toner as illustrated herein, and thereafter mixing these toners to obtain a blend of toners which comprises a palette of colors; a process for the preparation of a red color toner mixture, which comprises mixing a first toner composition comprised of a styrene butadiene resin, a magenta pigment, a charge enhancing additive mixture comprised of cetyl pyridinium chloride and an aluminum complex, and surface additives of colloidal silica particles and zinc stearate particles, and a blend compatibility component comprised of a calcium complex; and a second toner comprised of a styrene butadiene resin, a LITHOL SCARLET TM pigment, a magenta pigment, a charge enhancing additive comprised of distearyl dimethyl ammonium methyl sulfate, and surface additives of colloidal silica particles, zinc stearate particles, and a blend compatibility component comprised of a calcium complex; a process for the preparation of a purple color toner mixture which comprises mixing a first toner composition comprised of a styrene butadiene resin, PV FAST BLUE TM pigment, a charge enhancing additive mixture comprised of cetyl pyridinium chloride and an aluminum complex line BONTRON E-88 TM and surface additives of colloidal silica particles and zinc stearate particles, and a blend compatibility component comprised of an aluminum complex; and a second toner comprised of a styrene butadiene resin, a LITHOL SCARLET TM pigment, a magenta pigment, a charge enhancing additive comprised of distearyl dimethyl ammonium methyl sulfate, and surface additives of colloidal silica particles, and zinc stearate particles and a blend compatibility component comprised of an aluminum complex; and process for the preparation of a blue color toner mixture which comprises mixing a first toner composition comprised of a styrene butadiene resin, NEOPEN BLUE TM pigment, the charge enhancing additive distearyl dimethyl ammonium methyl sulfate (DDAMS), and surface additives of colloidal silica particles, and zinc stearate particles, and a compatibility component that is blended on the toner surface (SBCC, BCC) comprised of an aluminum complex; and a second toner comprised of a styrene butadiene resin, a LITHOL SCARLET TM pigment, a charge enhancing additive comprised of distearyl dimethyl ammonium methyl sulfate, and surface additives of colloidal silica particles and zinc stearate particles, and a blend compatibility component comprised of an aluminum complex.

The processes of the present invention comprise the following steps in embodiments: initially, the toners are prepared by conventional methods, such as melt mixing resin, pigment, and charge enhancing additive in effective known amounts, for example for the internal charge additive about 0.5 to about 10 weight percent. The external blend compatibility component (BCC) is either applied to the individual toners separately or to the toners comprising the blend simultaneously. The external BCC is typically applied to the toner or toners by mechanical mixing such as provided by a blender. When the BCC is applied to the constituent toners separately, then the toners are subsequently combined to form the blend by any number of mixing processes, such as tumbling or mechanical blending. When the BCC's are applied to the constituent toners simultaneously, there is typically utilized mechanical blending, that is a blender wherein all components, the toners and the external BCC's are combined. Additional surface additives, such as conductivity aids like metal salts of fatty acids, such as zinc stearate and flow aids like AEROSIL ®, may be applied either separately or together with the external BCC. Mixing times for the mechanical mixing processes range from about 5 to about 30 minutes, and more typically from about 5 to about 15 minutes, however, other effective times can be selected, The amount of external blend compatibility component is typically in the range of from about 0.01 to about 3 and preferably from about 0.01 to about 1 weight percent, however, other effective amounts may be selected in embodiments, such as from about 0.1 to about 5 weight percent. The primary function of the external blend compatibility component, or BCC is to provide improved blend compatibility as measured by the separation, or lack thereof in the charge spectrum of the toner blend and the admix time of the blend. The external blend compatibility component is not, it is believed, functioning as a primary charge director, as in fixing or moving the tribocharge of the toners, however, movement of tribocharge may be acceptable provided improved blend compatibility, as illustrated herein, is achieved. There results with the processes of the present invention in embodiments a blend or mixture of toners, especially two toners, which, for example, have a color, and in embodiments other characteristics dissimilar than the constituent initial toners, and which mixture functions after formulating with carrier particles as an electrophotographic developer.

A number of known blend compatibility additives can be selected for the processes of the present invention including those as illustrated in tile patents mentioned herein, the disclosures of each being totally incorporated herein by reference. Specific additives, which additives are dispersed on the toner, include quaternary ammonium compounds, distearyl dimethyl ammonium methyl sulfate, complexes such as BONTRON E-84 TM and E-88 TM available from Orient Chemical Company, reference U.S. Pat. No. 4,845,003, the disclosure of which is totally incorporated herein by reference, organic sulfonates such as stearylphenethyldimethyl ammonium tosylate (SPDAT), trialkyl hydrogen ammonium bisulfate such as distearyl methyl hydrogen ammonium bisulfate, trimethyl hydrogen ammonium bisulfate, triethyl hydrogen ammonium bisulfate, tributyl hydrogen ammonium bisulfate, dioctyl methyl hydrogen ammonium bisulfate, didodecyl methyl hydrogen ammonium bisulfate, dihexadecyl methyl hydrogen ammonium bisulfate, tris(3,5-di-t-butylsalicylato) aluminum available from Orient Chemical, potassium bis(3,5-di-t-butylsalicylato) borate available from Japan Carlit as LR120 TM, TN1001 believed to be a calcium salt of salicylatic acid and available from Hodogaya Chemical, tertiarybutyl salicyclic acid complexes, aluminum salt and zinc salt complexes, and the like. These additives are present in various effective amounts, such as for example from about 0.01 to about 10 weight percent, preferably from about 0.01 to about 5 weight percent, and more preferably from about 0.01 to about 1.

A number of known internal charge additive components can be selected including those as illustrated in the U.S. patents and copending applications mentioned herein, such as DDAMS, cetylpyridinium halides, bisulfates, aluminum complexes, zinc complexes, E-88 TM, E-84 TM, and the like, which additives are present in various effective amounts, such as, for example, from about 0.1 to about 10, and preferably from about 1 to about 3 weight percent. As internal charge additive, there may be selected the blend compatibility components illustrated herein.

In embodiments, a first toner, about 50 weight percent, comprised of 92.5 percent resin particles, such as styrene methacrylates or styrene butadienes, 5 percent of pigment, such as magenta, like HOSTAPERM PINK TM, internal charge additive, such as a mixture of 2 percent of BONTRON E-88 TM, an aluminum salt complex and 0.5 percent of cetylpyridinium chloride, external surface additives, such as 0.3 percent of AEROSIL ®, and 0.3 percent of zinc stearate, and a blend compatibility surface additive, such as 0.05 percent of LR120 TM believed to be potassium bis(3,5-di-t-butylsalicylato) borate, is mixed with a second toner, about 50 weight percent, comprised of 92 percent of resin particles, such as styrene methacrylates, or styrene butadienes, pigment, such as LITHOL SCARLET ® and 0.28 percent of HOSTAPERM PINK TM, internal charge additive, such as 1 percent of DDAMS, external surface additives, such as 0.3 percent of AEROSIL ®, and 0.3 percent of zinc stearate, and a blend compatibility surface additive, such as 0.05 percent of LR120 TM, to provide a red toner. Also, in embodiments a first toner, about 50 weight percent, comprised of 90.5 percent of resin particles, such as styrene methacrylates, or styrene butadienes, 7 percent of pigment, such as PV FAST BLUE TM, internal charge additive, such as a mixture of 2 percent of BONTRON E-88 TM and 0.5 percent of cetylpyridinium chloride, external surface additives, such as 0.3 percent of AEROSIL ®, and 0.3 percent of zinc stearate and a blend compatibility surface additive, such as 0.05 percent of BONTRON E-88 TM, is mixed with a second toner, about 50 weight percent, comprised of 92 percent of resin particles, such as styrene methacrylates, or styrene butadienes, 6.72 percent of pigment, such as LITHOL SCARLET ® and 0.28 percent of HOSTAPERM PINK TM, internal charge additive, external surface additives, such as 0.3 percent of AEROSIL ®, and 0.3 percent of zinc stearate, and a blend compatibility surface additive, such as 0.05 percent of BONTRON E-88 TM, to provide a purple toner. Moreover, in embodiments, a first toner, about 50 weight percent, comprised of 94.9 percent of resin particles, such as styrene methacrylates, or styrene butadienes, 5 percent of pigment, such as NEOPEN BLUE TM, internal charge additive, such as 0.1 percent of DDAMS, external surface additives, such as 0.3 percent of AEROSIL ®, and 0.3 percent of zinc stearate, and blend compatibility surface additives, such as 0.05 percent of BONTRON E-88 TM, is mixed with a second toner comprised of 92 percent of resin particles, such as styrene methacrylates, or styrene butadienes, pigment, such as LITHOL SCARLET ® and 0.28 percent of HOSTAPERM PINK TM, internal charge additive, such as 1 percent of DDAMS, external surface additives, such as 0.3 percent of AEROSIL ®, and 0.3 percent of zinc stearate, and a blend compatibility surface additive, such as 0.05 percent of LR120 TM, or a blend compatibility surface additive, such as 0.05 percent BONTRON E-88 ®, to provide a blue toner. More than two toners, that is a plurality of toners, for example up to 10, may, it is believed, be mixed in a similar manner to provide preselected colored toners as illustrated herein. The toners mixed can be utilized in various effective amounts, such as for example from about 1 to about 99 percent of the first toner, and about 99 to about 1 percent of the second toner, but more preferably from about 90 to about 10 of the first toner and about 10 to about 90 of the second toner.

The toner compositions of the present invention can be prepared by a number of known methods such as admixing and heating resin particles such as styrene butadiene copolymers, pigment particles such as magnetite, carbon black, color pigments, or mixtures thereof, and preferably from about 0.5 percent to about 5 percent of the aforementioned internal charge enhancing additives, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, there is added to the toner as a surface additive the blend compatibility component illustrated herein.

Illustrative examples of suitable toner resins selected for the toners include polyamides, polyolefins, styrene acrylates, styrene methacrylates, styrene butadienes, PLIOTONE ®, a styrene butadiene available from Goodyear Chemical, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Specific examples of toner resins include styrene butadiene copolymers; with a styrene content of from about 70 to about 95 weight percent, reference the U.S. patents mentioned herein, the disclosures of which have been totally incorporated herein by reference. In addition, crosslinked resins, including polymers, copolymers, and homopolymers of the aforementioned styrene polymers may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers and styrene/-butadiene copolymers; PLIOLITES TM; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 7,000 such as polyethylene, polypropylene, and paraffin waxes can be included in, or on the toner compositions as fuser roll release agents. Also, the extruded polyesters of copending patent applications U.S. Ser. No. 814,641 (D/91117) and U.S. Ser. No. 814,782 (D/911170), the disclosures of which are totally incorporated herein by reference, can be selected as the toner resin.

The resin particles are present in a sufficient, but effective amount, for example from about 70 to about 90 weight percent. Thus, when 1 percent by weight of the dispersed internal charge enhancing additive is present, and 10 percent by weight of pigment or colorant, such as carbon black, is contained therein, about 89 percent by weight of resin is selected. The blend compatibility component is present on the toner surface in various effective amounts, such as for example from about 0.01 to about 1 weight percent.

Numerous well known suitable pigments or dyes can be selected as the colorant for the toner particles including, for example, carbon black, like REGAL 330®, nigrosine dye, aniline blue, magnetite, or mixtures thereof. The pigment is generally present in various effective amounts, such as in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be present in embodiments. Preferred pigments selected are colored pigments other than black and magnetites, as illustrated herein.

When the pigment particles are comprised of magnetites, thereby enabling single component toners in some instances, which magnetites are considered to be a mixture of iron oxides ($FeO$-$Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, titanium oxides, other similar metal oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the blend compatibility additives of the present invention illustrated herein in an amount of from about 1 to about 30 weight percent, and preferably 10 weight percent followed by the addition thereof to the toner in an amount of from 0.1 to 10, and preferably 0.1 to 1 weight percent.

There can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference.

The low molecular weight wax materials are usually present in the toner composition of the present invention in various amounts, however, generally these waxes are present in or on the toner composition in an amount of from about 1 percent by weight to about 15 percent by weight, and preferably in an amount of from about 2 percent by weight to about 10 percent by weight.

Examples of toner colorants, or pigments other than black include red like LITHOL SCARLET TM, blue, green, like Heliogen Green, brown, magenta, cyan and/or yellow pigments, dyes, or mixtures thereof. More specifically, with regard to the generation of color images utilizing a toner composition with blend compatibility additives on the surface, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, HOSTAPERM PINK E® or HOSTAPERM PINK EB®, both obtained from Hoechst A.G. of Germany, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, PV FAST BLUE TM, Neopen Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts. In embodiments, these colored pigment particles are present in the toner composition in an amount of from about 2 percent by weight to about 15 percent by weight calculated on the weight of the toner resin particles.

For the formulation of developer compositions, there are mixed, or comixed with the toner carrier components, particularly those that are capable of triboelectrically assuming an opposite polarity to that of the toner composition. Accordingly, the carrier particles can be selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, continuous or semicontinuous, which coating can be present in embodiments in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. No. 4,937,166 and U.S. Pat. No. 4,935,326, the disclosures of which are totally incorporated herein by reference, including for example KYNAR ® and polymethylmethacrylate mixtures (40/60). Coating weights can vary as indicated herein; generally, however, from about 0.3 to about 2, and preferably from about 0.5 to about 1.5 weight percent coating weight, are selected. Carriers can be selected to also enable negatively charged toners.

Furthermore, the diameter of the carrier particles, preferably spherical in shape, is generally from about 50 microns to about 1,000, and preferably about 175 microns thereby permitting them to possess sufficient density and inertia to avoid adherence to the electrostatic images during the development process. The carrier component can be mixed with the toner composition in various suitable combinations, however, in embodiments about 1 to 5 parts per toner to about 100 parts to about 200 parts by weight of carrier are selected.

The toner and developer compositions of the present invention may be selected for use in electrostatographic imaging and printing apparatuses containing therein conventional photoreceptors that are capable of being charged negatively. Thus, the toner and developer compositions can be used with layered photoreceptors comprised of photogenerating layers and charge transport layers, and that are capable of being charged negatively, such as those described in U.S. Pat. No. 4,265,990, the disclosure of which is totally incorporated herein by reference. Illustrative examples of inorganic photoreceptors that may be selected for the imaging and printing processes include selenium; selenium alloys, such as selenium arsenic, selenium tellurium and the like; halogen doped selenium substances; and halogen doped selenium alloys. Other similar photoreceptors can be selected providing many of the main objectives of the present invention are achievable. Also, the toners obtained with the processes of the present invention can be selected for trilevel color xerography, reference U.S. Pat. No. 4,078,929, the disclosure of which is totally incorporated herein by reference.

The toner compositions are usually jetted and classified subsequent to preparation to enable toner particles with a preferred average diameter of from about 5 to about 25 microns, and more preferably from about 8 to about 12 microns. Also, the toner compositions of the present invention preferably possess a triboelectric charge of from about 0.1 to about 2 femtocoulombs per micron in embodiments thereof as determined by the known charge spectograph. Admix time for the toners of the present invention are preferably from about 5 seconds to 1 minute, and more specifically from about 5 to about 15 seconds in embodiments thereof as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Further, the toner compositions of the present invention in embodiments thereof possess desirable narrow charge distributions, optimal charging triboelectric values, preferably of from 10 to about 40, and more preferably from about a positive or negative 10 to about 35 microcoulombs per gram with from about 0.1 to about 5 weight percent in embodiments of the internal charge enhancing additive, and from about 0.01 to about 5, and preferably 1 weight percent of surface compatibility component; and rapid admix charging times as determined in the charge spectrograph of less than about 1 minute, preferably about 15 seconds, and more preferably in some embodiments from about 1 to about 14 seconds.

The following Examples are being provided to further define various species of the present invention, it being noted that these Examples are intended to illustrate and not limit the scope of the present invention. Parts and percentages are by weight unless otherwise indicated.

EXAMPLE I

There was prepared in an extrusion device, available as ZSK28 from Werner Pfleiderer, a red toner composition by adding to the device a first toner comprised of 92.5 percent by weight of suspension polymerized styrene butadiene copolymer resin particles (87/13), reference U.S. Pat. No. 4,558,108, the, disclosure of which is totally incorporated herein by reference; 5 weight percent of the pigment HOSTAPERM PINK E TM, 2 percent by weight of the charge enhancing additive BONTRON E-88 TM, and 0.5 percent by weight of CPC (cetyl pyridinium chloride charge additive). The toner product which was extruded at a rate of 15 pounds per hour reached a melting temperature of 212° F. The strands of melt mixed product exiting from the extruder were cooled by immersing them in a water bath maintained at room temperature, about 25° C. Subsequent to air drying, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for tile primary purpose of removing fine particles, that is those with a volume median diameter of less than 4 microns. There was then added to the toner surface 0.3 percent of AEROSIL R972 ® and 0.3 percent of zinc stearate, and the blend compatibility component, 0.05 weight percent of LR120 TM, believed to be potassium bis(3,5-di-t-butylsalicylato) borate and obtained from Carlit of Japan, by mixing the toner, the surface additives and blend component in a ball mill for 30 minutes.

A second toner was prepared by repeating the above process except that the pigment LITHOL SCARLET TM was selected in place of the HOSTAPERM PINK TM, reference toner 1 of Example II.

The aforementioned second and first toners were then mixed and blended in a 50:50 ratio, and there resulted a red toner with excellent electrical characteristics, and when the blended toner was formulated into a developer as indicated hereinafter and utilized in a Xerox Corporation 4850 there resulted red images with excellent color intensity and superior line and solid resolution.

The above formulated toner mixture, 3 parts by weight, was mixed with 97 parts by weight of a carrier containing a steel core coated with a polymer mixture thereof, 0.8 percent by weight, which polymer mixture contained 20 percent by weight of VULCAN BLACK TM carbon black, and 80 parts by weight of polymethyl methacrylate, and wherein mixing was accomplished in a roll mill for 60 minutes to form a developer. There resulted on the toner composition, as determined in the known Faraday Cage apparatus, a negative triboelectric charge of −26 microcoulombs per gram, and an admix time of 1 minute as determined in a charge spectrograph.

Toners and developers were prepared by repeating the above process with and without the surface blend compatibility components (SBCC), reference the following Table: One criteria for determining the effectiveness of the SBCC is the ability of the blend or mixture of toners to function as a single toner in a developer as judged, for example, by the overlap of the charge distributions of the component toners in the blend and the admix time of the blend. The overlap of the charge distributions of the component toners in the blend can be measured by any number of metrics, such as a sharpness factor, low toner charge fraction or wrong sign toner fraction; however, for the purposes of these Examples, the degree of overlap is primarily indicated in order of increasing overlap as poor, better, good and excellent from charge spectrograph measurements. Admix times are often cited in minutes or seconds; for the purposes of these Examples, the admix behaviors have been classified in categories which are labeled in order of decreasing admix time as long, medium and short. Long admix is about 15 minutes; medium admix is from about 2 to about 5 minutes; short admix or rapid admix, which is more desired, is about 30 second to about 1 minute. In each Example in the Table, the toner blend is prepared first without and then with the surface blend compatibility component. The blend without: the SBCC was not considered functional due to either the poor overlap of the charge distribution of the component toners or a long admix time of 2 minutes for example. When the SBCC has added to the surface of the toners in the blend either the overlap of the charge distribution of the component toners or the blend admix has improved, which blend was fully functional in a xerographic developer.

The composition of the toners were as follows:

| | PIGMENT | RESIN | INTERNAL CCA | EXTERNAL ADDITIVE | SBCC |
|---|---|---|---|---|---|
| Example II Toner 1 | 6.72% Lithol Scarlet 0.28% Hostaperm Pink | 92.0% Pliotone | 1.0% DDAMS | 0.3% Aerosil R972 0.3% Zn Stearate | 0.05% E-88 |
| Example II Toner 2 | 7.0% PV Fast Blue | 90.5% Pliotone | 2.0% E-88 0.5% CPC | 0.3% Aerosil R972 0.3% Zn Stearate | 0.05% E-88 |
| Example III Toner 1 | 6.72% Lithol Scarlet 0.28% Hostaperm Pink | 92.0% Pliotone | 1.0% DDAMS | 0.3% Aerosil R972 0.3% Zn Stearate | 0.1% E-88 |
| Example III Toner 2 | 7.0% PV Fast Blue | 90.5% Pliotone | 2.0% E-88 0.5% CPC | 0.3% Aerosil R972 0.3% Zn Stearate | 0.1% E-88 |
| Example IV Toner 1 | 5.0% Neopen Blue | 94.9% Pliotone | 0.1% DDAMS | 0.3% Aerosil R972 0.3% Zn Stearate | 0.025% E-88 |
| Example IV Toner 2 | 5.0% Hostaperm Pink E | 92.5% Pliotone | 2.0% E-88 0.5% CPC | 0.3% Aerosil R972 0.3% Zn Stearate | 0.025% E-88 |
| Example V Toner 1 | 5.0% Neopen Blue | 94.9% Pliotone | 0.1% DDAMS | 0.3% Aerosil R972 0.3% Zn Stearate | 0.05% E-88 |
| Example V Toner 2 | 6.72% Lithol Scarlet 0.28% Hostaperm Pink | 92.0% Pliotone | 1.0% DDAMS | 0.3% Aerosil R972 0.3% Zn Stearate | 0.05% E-88 |
| Example VI Toner 1 | 2.0% PV Fast Blue | 97.0% Pliotone | 1.0 DDAMS | 0.3% Aerosil R972 0.3% Zn Stearate | 0.05% E-88 |
| Example VI Toner 2 | 5.0% Hostaperm Pink E | 92.5% Pliotone | 2.0% E-88 0.5% CPC | 0.3% Aerosil R972 0.3% Zn Stearate | 0.05% E-88 |
| Example VII Toner 1 | 2.0% PV Fast Blue | 97.0% Pliotone | 1.0% DDAMS | 0.3% Aerosil R972 0.3% Zn Stearate | 0.05% LR120 |
| Example VII Toner 2 | 5.0% Hostaperm Pink E | 92.5% Pliotone | 2.0% E-88 0.5% CPC | 0.3% Aerosil R972 0.3% Zn Stearate | 0.05% LR120 |

-continued

| | PIGMENT | RESIN | INTERNAL CCA | EXTERNAL ADDITIVE | SBCC |
|---|---|---|---|---|---|
| Example VIII Toner 1 | 2.0% PV Fast Blue | 95.5% Pliotone | 2.0% E-88 0.5% CPC | 0.3% Aerosil R972 0.3% Zn Stearate | 0.1% E-88 |
| Example VIII Toner 2 | 6.72% Lithol Scarlet 0.28% Hostaperm Pink | 92.0% Pliotone | 1.0% DDAMS | 0.3% Aerosil R972 0.3% Zn Stearate | 0.1% E-88 |

| BLEND COMPOSITION | CHARGE DISTRIBUTION OVERLAP | | BLEND ADMIX TIME | | SBCC TYPE (WT %) |
|---|---|---|---|---|---|
| | NO SBCC* | WITH SBCC | NO SBCC | WITH SBCC | |
| Example II Red:Blue (1:1 Toner Blend) | Poor | Excellent | Long | Medium | E-88 (0.05) |
| Example III Red:Blue (1:1 Toner Blend) | Poor | Excellent (better overlap than above) | Long | Medium | E-88 (0.1) |
| Example IV Cyan:Magenta (1:1 Toner Blend) | Poor | Excellent | Medium | Short | E-88 (0.025) |
| Example V Cyan:Red (1:1 Toner Blend) | Poor | Excellent | Medium | Short | E-88 (0.05) |
| Example VI Cyan:Magenta (1:1 Toner Blend) | Poor | Excellent | Medium | Medium | E-88 (0.05) |
| Example VII Cyan:Magenta (1:1 Toner Blend) | Poor | Excellent | Medium | Short | LR120 (0.05) |
| Example VIII Cyan:Red (1:1 Toner Blend) | Poor | Excellent | Long | Medium | E-88 (0.1) |
| Example I Magenta:Red (1:1 Toner Blend) | Poor | Good | Medium | Medium | LR120 (0.05) |

*SBCC = Surface Blend Compatibility Component
1:1 refers to the ratio of first and second toner blended; thus Red:Blue, Example II, (1:1 toner blend) refers to blending Toner 1 and Toner 2 of Example II in a 1 to 1 ratio.

Other modifications of the present invention may occur to those skilled in the art subsequent to a review of the present application, and these modifications, including equivalents thereof, are intended to be included within the scope of the present invention.

What is claimed is:

1. A process for the preparation of nonencapsulated colored toners consisting essentially of providing a first toner comprised of resin, pigment particles, internal charge additive, and optional surface additives; adding thereto a second toner comprised of resin, pigment particles, internal charge additive, and optional surface additives; and wherein said toners contain blend compatibility components; and which blend compatibility components are present on the surface of said first toner and said second toner thereby enabling effective improved blending or comixing compatibility of said first and said second toner.

2. A process in accordance with claim 1 wherein the resin particles are comprised of styrene acrylates, styrene methacrylates, styrene butadienes, or polyesters.

3. A process in accordance with claim 1 wherein the pigment particles are comprised of red, green, blue, yellow, brown, cyan, magenta, or mixtures thereof.

4. A process in accordance with claim 1 wherein the blend compatibility component is present on the first and second toner surface, and said component is a charge enhancing additive.

5. A process in accordance with claim 1 wherein the blend compatibility component is comprised of an aluminum complex salt.

6. A process in accordance with claim 1 wherein the blend compatibility component is distearyl dimethyl ammonium methyl sulfate.

7. A process in accordance with claim 1 wherein the blend compatibility component is present in an amount of from about 0.01 to about 1 weight percent.

8. A process in accordance with claim 1 wherein the internal charge additive is comprised of a mixture of charge additives.

9. A process in accordance with claim 8 wherein the internal charge additive mixture is comprised of from about 0.1 to about 5 weight percent of a first charge additive and from about 0.1 to about 5 weight percent of a second charge additive.

10. A process in accordance with claim 9 wherein the first internal charge additive is an aluminum complex salt and the second charge additive is an alkyl pyridinium halide.

11. A process in accordance with claim 9 wherein the first charge additive is tris(3,5-di-tertiary-butylsalicylato) aluminum and the second charge additive is the alkyl pyridinium halide cetyl pyridinium chloride.

12. A process in accordance with claim 1 wherein from about 1 to about 99 percent of the first toner is added to from about 99 to 1 percent of the second toner.

13. A process in accordance with claim 1 wherein a plurality of colored toners are blended.

14. A process for the preparation of nonencapsulated blended dry toners consisting essentially of the preparation of a first toner, the preparation of a second toner, the preparation of a third toner, and the preparation of a fourth toner by the process of claim 1, and thereafter mixing these toners to obtain a blend of dry toners which blend is comprised of a palette of colors.

15. A process for the preparation of developer compositions which comprises mixing the toner product of claim 15 with carrier particles.

16. A process in accordance with claim 14 wherein two toners are mixed to obtain a third toner mixture with a color different than the first or second toner.

17. A process for the preparation of developer compositions which comprises mixing the toner mixture product of claim 16 with carrier particles.

18. A process in accordance with claim 1 wherein the internal charge additive is selected from the group consisting of alkyl pyridinium halides, metal complex salts, and quaternary ammonium compounds.

19. A process in accordance with claim 1 wherein the internal charge additive is selected from the group consisting of cetyl pyridinium chloride and distearyl dimethyl ammonium methyl sulfate.

20. A process in accordance with claim 1 wherein the pigment particles are comprised of cyan, magenta, yellow, red, blue or mixtures thereof.

21. A process for the preparation of developer compositions which comprises mixing the toner product of claim 1 with carrier particles.

22. A process in accordance with claim 1 wherein said surface additives are comprised of metal salts of fatty acids, colloidal silica particles, metal oxides, or mixtures thereof.

23. A process in accordance with claim 1 wherein said surface additives are comprised of a mixture of metal salts of fatty acids and colloidal silica.

24. A process in accordance with claim 1 wherein said surface additives are comprised of zinc stearate and colloidal silica particles.

25. A process in accordance with claim 1 wherein said surface additives are present in an amount of from about 0.1 to about 3 weight percent.

26. A process in accordance with claim 1 wherein said first toner and said second toner contain a blend compatibility component or a mixture of said components.

27. A process in accordance with claim 1 wherein the resin for the first toner is comprised of suspension polymerized styrene butadiene copolymer, the pigment is HOSTAPERM PINK TM, the charge additive is cetylpyridinium chloride, the blend compatibility component is potassium bis(3,5-di-t-butylsalicylato) borate, and wherein the second toner is comprised of suspension polymerized styrene butadiene copolymer, the pigment is LITHOL SCARLET TM, the charge additive is cetylpyridinium chloride, the blend compatibility component is potassium bis(3,5-di-t-butylsalicylato)borate; and which toners are mixed in a ratio of from about 50:50 and wherein the resulting mixed toner had an admix time of about 1 minute.

28. A process for the preparation of a purple color dry toner mixture free of encapsulation which comprises mixing a first toner composition comprised of a styrene butadiene resin, PV FAST BLUE TM pigment, a charge enhancing additive mixture comprised of cetyl pyridinium chloride and an aluminum complex, and surface additives of colloidal silica particles and zinc stearate particles, and a blend compatibility component comprised of an aluminum complex; and a second toner comprised of a styrene butadiene resin, a LITHOL SCARLET TM pigment, a magenta pigment, a charge enhancing additive comprised of distearyl dimethyl ammonium methyl sulfate, and surface additives of colloidal silica particles, and zinc stearate particles and a blend compatibility component comprised of an aluminum complex; and wherein said compatibility component for said first toner and said second toner is present on the surface thereof thereby enabling improved blending or comixing of said toners.

29. A process for the preparation of a nonencapsulated dry blue color toner mixture consisting essentially of mixing a first toner composition comprised of a styrene butadiene resin, NEOPEN BLUE TM pigment, the charge enhancing additive distearyl dimethyl ammonium methyl sulfate, and surface additives of colloidal silica particles, and zinc stearate particles, and a blend compatibility component comprised of an aluminum complex; and a second toner comprised of a styrene butadiene resin, a LITHOL SCARLET TM pigment, a charge enhancing additive comprised of distearyl dimethyl ammonium methyl sulfate, and surface additives of colloidal silica particles and zinc stearate particles, and a blend compatibility component comprised of an aluminum complex; and wherein the blend compatibility component for said first and said second toner is present on the surface of the toner.

30. A process for the preparation of a dry colored toner mixture containing a first toner comprised of resin, pigment particles, internal charge additive, and optional surface additives, and a second toner comprised of resin, pigment particles, internal charge additive, and optional surface additives, the improvement residing in adding to the surface of said toners blend compatibility components thereby enabling a colored toner with excellent comixing compatibility.

* * * * *